United States Patent [19]

Coughlin

[11] 4,279,710

[45] Jul. 21, 1981

[54] METHOD OF GASIFYING CARBONACEOUS MATERIALS

[75] Inventor: Robert W. Coughlin, Bethlehem, Pa.

[73] Assignee: University Patents, Inc., Norwalk, Conn.

[21] Appl. No.: 91,660

[22] Filed: Nov. 5, 1979

Related U.S. Application Data

[63] Continuation of Ser. No. 840,567, Oct. 11, 1977, abandoned.

[51] Int. Cl.[3] ..... C25B 1/02; C25B 5/00; C25B 1/00

[52] U.S. Cl. ..... 204/101; 204/129; 204/DIG. 4

[58] Field of Search ..... 204/101, 129, 105 R, 204/DIG. 4

[56] References Cited

U.S. PATENT DOCUMENTS

| | | | |
|---|---|---|---|
| 2,384,463 | 9/1945 | Gunn et al. | 204/DIG. 4 |
| 3,180,813 | 4/1965 | Wasp et al. | 204/DIG. 4 |
| 3,556,749 | 1/1971 | Spacil | 43/77 |
| 3,766,027 | 2/1972 | Gregory et al. | 204/72 |
| 4,011,148 | 3/1977 | Goudal | 204/129 |
| 4,043,881 | 8/1977 | Yen et al. | 204/130 |
| 4,048,029 | 9/1977 | Seltzer | 204/129 |
| 4,081,337 | 3/1978 | Spitzer | 204/129 |
| 4,092,129 | 5/1978 | Goudal | 204/129 |
| 4,158,637 | 6/1979 | Jones | 204/104 |

FOREIGN PATENT DOCUMENTS

| | | | |
|---|---|---|---|
| 966429 | 8/1964 | United Kingdom | 204/DIG. 4 |

OTHER PUBLICATIONS

"Coal Cuts Energy Use in Metal Electrowinning," C. & En., Sep. 10, 1979, pp. 28–29.

*Primary Examiner*—R. L. Andrews
*Attorney, Agent, or Firm*—Martin Novack

[57] ABSTRACT

Electrochemical method and associated apparatus permit carbonaceous materials to be gasified to carbon oxides under mild conditions with the attendant formation of fuels or high energy intermediates such as hydrogen, or light hydrocarbons and production of electric power.

10 Claims, 4 Drawing Figures

METHOD OF GASIFYING CARBONACEOUS MATERIALS

The Government has rights in this invention pursuant to Grant No. EF-77-G-01-2731.

This is a continuation of application Ser. No. 840,567, filed Oct. 11, 1977, now abandoned.

BACKGROUND OF THE INVENTION

1. Field of the Invention

The present invention relates to the conversion of carbonaceous materials into gaseous or liquid products which may be used as fuels or as chemical intermediates. The starting carbonaceous materials include coal, lignite, char, municipal and agricultural waste, sewage sludge, shale oil and heavy petroleum fractions. The well known processes for converting these materials into gaseous products involve causing the carbonaceous material to react at elevated temperatures with mixtures of steam and air or steam and oxygen or merely air in order to produce a synthesis gas containing carbon monoxide and hydrogen, and often also containing methane, other hydrocarbons and tar. The principal chemical reactions involved in such gasification are discussed below under Prior Art.

Prior Art

Previous disclosures are legion for methods of gasifying carbonaceous materials such as coal. Generally such methods teach heating the carbonaceous materials in gases such as steam ($H_2O$) or hydrogen, often at elevated temperatures and pressures; high temperatures and pressures being desired to accelerate rate of chemical reaction between gas and the carbonaceous material. In the following disclosure the carbon in carbonaceous materials will be of major concern and, in writing chemical reactions or discussing mass balance, such carbon will be represented by the chemical symbol, C. The gasification of such carbonaceous materials with steam may be represented by the chemical reactions:

$$\text{(I)}\ C+H_2O \rightarrow CO+H_2 \quad \Delta F^\circ=+21.8\ \text{kcal} \quad \Delta H^\circ=+31.4\ \text{kcal/mole}$$

$$\text{(II)}\ C+2H_2O \rightarrow CO_2+2H_2 \quad \Delta F^\circ=+14.9\ \text{kcal} \quad \Delta H^\circ=21.5\ \text{kcal/mole}$$

Here $\Delta F^\circ$ and $\Delta H^\circ$ represent respectively the free energy and enthalpy changes of the chemical reactions under standard conditions of 1 atmosphere pressure and 25° C. Because $\Delta F^\circ$ is positive at room temperature it is necessary to conduct the above reactions at elevated temperatures (above 900° C.) to realize practical equilibrium yields; $\Delta H$ remains positive, even at higher temperatures, and this enthalpy of reaction is very often supplied by combusting a portion of the carbonaceous material according to the equation:

$$\text{(III)}\ C+O_2 \rightarrow CO_2 \quad \Delta F^\circ=-94.3\ \text{kcal}\ \Delta H^\circ=-94.1\ \text{kcal}$$

The invention which I disclose below permits gasification at low temperature by overcoming the positive $\Delta F^\circ$ of reactions I and II by an applied electromotive force during electrolysis in an aqueous electrolyte. My method of electrochemical gasification may also supply the enthalpy of gasification at least in part by electrical means. Most important, this new method of gasification which I describe below permits the production of $H_2$ as a relatively pure gas whereas the prior-art methods of gasification ordinarily produce a so called "synthesis gas" mixture comprising $H_2$, $CO_2$, CO and other components.

Other relevant prior art is that of Vaaler [J. Electrochem Soc. 107, 691–698 (1960); Electrochem Technology 5, 170–173 (1967)] and Janssen and Hoagland [Electrochim. Acta 14, 1097–1108 (1969)], who observed and disclosed that carbonaceous electrodes are consumed during brine electrolysis to produce $CO_2$. Other relevant work is that of Binder et al [Electrochimica Acta 9, 255–274 (1964)] who observed that in aqueous solutions of sulfuric and phosphoric acid various carbonaceous materials such as active carbon, soot, charcoal and graphite could be anodically oxidized in aqueous electrolytes to $CO_2$ while working at potentials below that which causes the evolution of oxygen. Working with aqueous electrolytes of sulfuric and phosphoric acid Binder was able to convert up to 80% of his carbon to $CO_2$ working at temperatures of 55° to $CO_2$ working at temperatures of 55° to 100° C. Whereas the investigators mentioned just above observed and recognized that carbonaceous materials can be oxidatively consumed when anodically polarized during electrolysis, they all failed to perceive that the oxidative consumption of the carbonaceous matter at the anode might permit the liberation of hydrogen at the cathode with a far lower consumption of electrical energy than in the case where water is electrolyzed using non-consumable electrodes. My invention takes advantage of the anodic consumption of carbonaceous materials during electrolysis of an aqueous electrolyte to produce an amount of hydrogen at the cathode that, in terms of its available chemical free energy, exceeds the quantity of electric energy thereby consumed in the process. The source of the available free energy thereby produced in the form of hydrogen is in part the anodic oxidation of the carbonaceous material and in part the electrical energy supplied to the electrolysis process.

In the subsequent discussion the standard electrochemical potential of a reaction is symbolized by E° and refers to one atmosphere pressure and 25° C. The relationship between $\Delta F^\circ$ and E° is $\Delta F^\circ=-nFE^\circ$, where n is the number of electrons involved in the chemical reaction and F is the Faraday constant and equal to about 96,500 coulombs per equivalent.

SUMMARY OF THE INVENTION

The present invention provides electrochemical gasification of coal in an anodic half cell reaction:

$$\text{(IV)}\ C+2H_2O \rightarrow CO_2+4H^++4e^- \quad E^\circ=0.21\ \text{volt}$$

in combination with the corresponding cathodic half-cell reaction:

$$\text{(V)}\ 4H^++4e \rightarrow 2H_2 \quad E^\circ=0.0\ \text{volt}$$

The net sum of these half cell reactions (equations IV and V) is just the steam gasification reaction, equation II; but the electrochemical gasification process of my invention, instead of producing a mixture of CO, $CO_2$ and $H_2$ as does prior art gasification methods, can produce relatively pure streams of $CO_2$ at the anode and $H_2$ at the cathode. It will often be possible to practice my invention with only very little CO produced at the anode, even under relatively mild conditions. My invention can therefore produce relatively pure hydrogen without the necessity of purification to remove gases such as $CO_2$; this constitutes a distinct advantage of the method I teach herein over the prior art. It should be noted that my invention is not merely a method of water electrolysis which is described by the following equations:

$$\text{(VI.A)} \quad 2H^+ + 2e^- \longrightarrow H_2 \text{ (at the cathode)}$$

$$\text{(VI.B)} \quad H_2O \longrightarrow \tfrac{1}{2} O_2 + 2H^+ + 2e^- \text{ (at the anode)}$$

$$\text{(VI.)} \quad H_2O \longrightarrow H_2 + \tfrac{1}{2} O_2 \; \Delta F^\circ = +54.6 \; \Delta H^\circ = +57.8$$

For a comparison of water electrolysis (equation VI) with electrochemical gasification of coal by equation II, note that water electrolysis (equation VI) requires 54.6 kcal of electrical energy ($\Delta F$) to produce a mole of $H_2$, whereas my method (equation II or combined equations IV and V) requires only about 7.5 kcal of electrical energy to produce a mole of $H_2$ because carbonaceous material is oxidized during the process I teach. Thus, significant thermodynamic and energetic advantage is offered by my invention of electrochemical gasification of coal as a means of producing $H_2$.

By my method the free energy content of carbonaceous material (e.g. coal) is utilized to produce as a product another fuel or intermediate (e.g. $H_2$) that is very easily and conveniently utilizable and which possesses a high available free energy content. The standard electrode potentials for the anodic gasification of carbon are:

$$C + H_2O \rightarrow CO + 2H^+ + 2e^- \quad E^\circ = 0.52 \text{ volt}$$

$$C + 2H_2O \rightarrow CO_2 + 4H^+ + 4e^- \quad E^\circ = 0.21 \text{ volt}$$

This means that this process of combined equations IV and V can be driven by low voltages-lower than those which will electrolyze water:

$$2H_2O \rightarrow O_2 + 4H^+ + 4e^- \quad E^\circ = 1.23 \text{ volts}$$

or liberate chlorine from a brine solution:

$$2Cl^- \rightarrow Cl_2 + 2e^- \quad E^\circ = 1.36 \text{ volts}$$

For example, it also means that a hydrogen fuel cell of ideal voltage about 1.2 can readily drive the electrochemical gasification signified by combined equations IV and V.

SPECIFIC EMBODIMENTS

Figure 1:
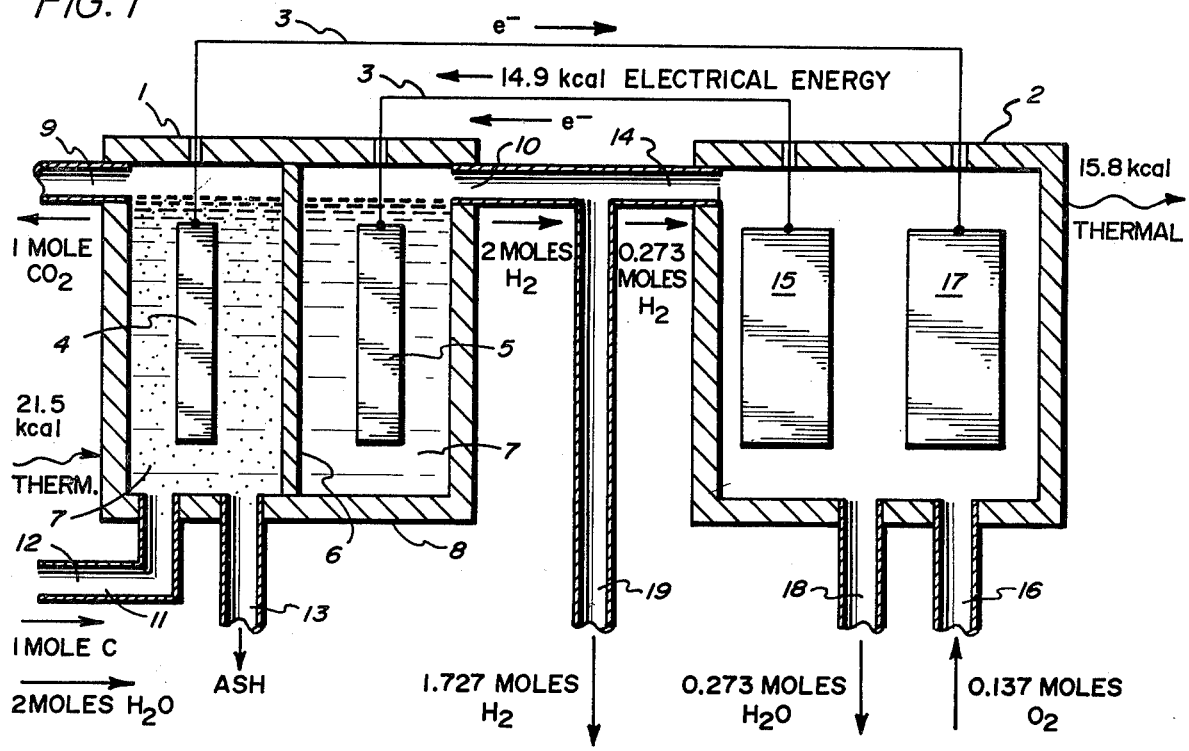
FIG. 1 is a schematic diagram of an electrochemical gasification cell connected electrically to a hydrogen fuel cell; the gasification cell supplies hydrogen to the fuel cell.

FIG. 1 depicts an EGC 1 connected to a hydrogen fuel cell 2 by wires 3. The EGC has an anode 4 and a cathode 5; these electrodes may be of Pt, stainless steel or other suitable conductors and preferred embodiments will make use of chemically inert materials for the anode 4 and materials of low hydrogen overvoltage for the cathode 5. The EGC is also provided with a membrane 6 permeable to ions and filled with an electrolyte 7 held in EGC body or vessel 8; the electrolyte 7 may be an aqueous solution of $H_2SO_4$ or $HNO_3$, or of NaOH, or of NaCl or it may be a fused salt in some instances. In some cases, membrane 6 and electrolyte 7 may be replaced by an organic ion-exchange resin membrane serving as the electrolyte as disclosed in U.S. Pat. No. 2,913,511. The EGC of FIG. 1 is shown for the case of an aqueous electrolyte and includes conduit means for withdrawal of $CO_2$ at 9 and $H_2$ at 10 as well as means for feeding water at 11 and carbonaceous material at 12 and withdrawing ash and unreacted solid material at 13. The HFC 2 of FIG. 1 is equipped with means for feeding $H_2$ at 14 so that the $H_2$ will be oxidized at the fuel cell electrode 15. Oxygen, air or other oxidizing gas is introduced to the HFC at 16 and is reduced at the oxygen electrode 17. Conduit means are also provided at 18 for the removal of excess water formed in the HFC by combination of the $H_2$ and $O_2$ feed. The technology and details of hydrogen fuel cells are disclosed in U.S. Pat. Nos. 2,570,543; 2,581,650; 2,581,651 and 2,925,454 incorporated herein by reference. Conduit means are provided at 19 for the removal of the excess $H_2$ produced by the EGC-HFC combination of FIG. 1. The mass and energy flows shown in FIG. 1 are computed below as part of Example 1.

Figure 2:
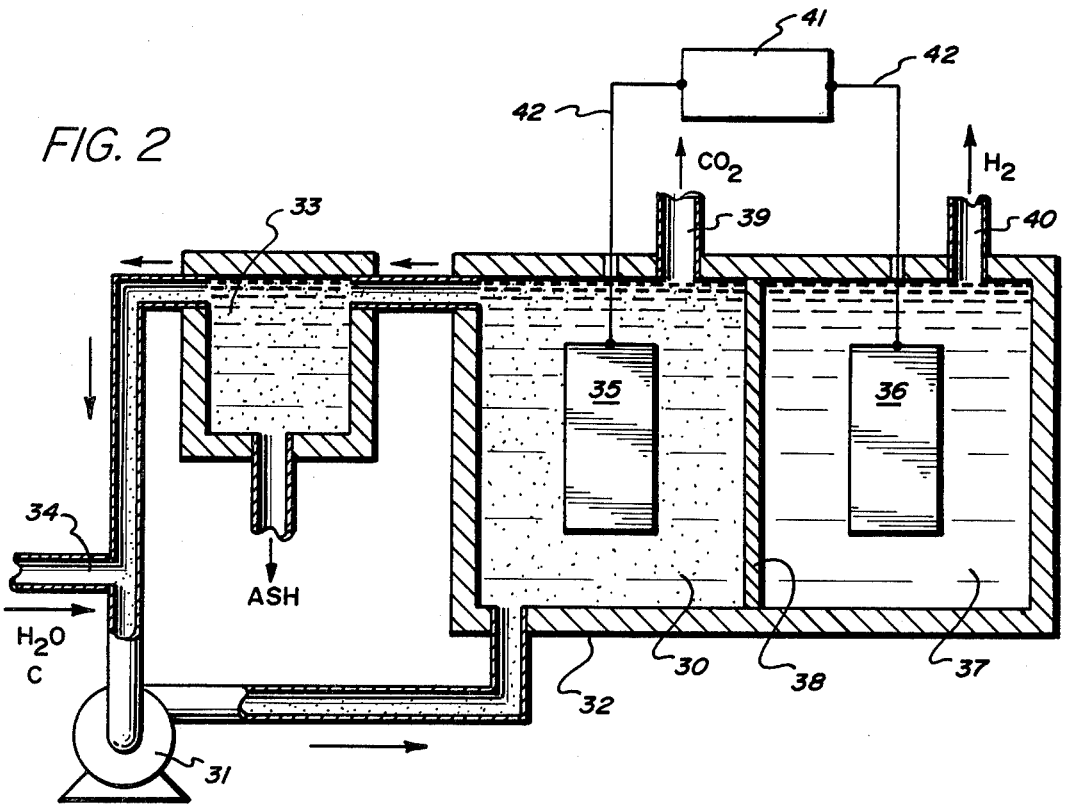
FIG. 2 is a schematic diagram of an electrochemical gasification cell showing in more detail the operation of its anode compartment during continuous feed of carbonaceous material thereto.

FIG. 2 shows schematically an embodiment of the EGC of FIG. 1 in which the anolyte electrolyte 30 is circulated by pump means 31 through the anode compartment 32 and settling-chamber means 33 carrying with it carbonaceous material and ash; the ash is separated by gravity in settling-chamber means 33. Carbonaceous material is fed at 34 and contacts the anode 35. Required water is also fed at 34. The EGC of FIG. 2 also includes a cathode 36, catholyte electrolyte 37, ion-permeable membrane 38, and means for removing $CO_2$ at 39 and $H_2$ at 40. Anode 35 and cathode 36 of the EGC are electrically connected to DC power source 41 (which may be an HFC) by wires 42. In preferred embodiments of the invention the circulation of electrolyte, ash and carbonaceous material through anode compartment 32 will constitute a fluidized-bed, moving-bed, expanded-bed or pumped-slurry electrodes; such 3-dimensional electrodes are disclosed and described in British Pat. No. 1,194,181; articles by Fitzjohn (Chemical Engineering Progress 71, No. 2, pp. 85–91, February 1975); Brockhurst et al (J. Electrochem Soc. 116, No. 11, pp. 1600–1607 (1969); Baria et al (J. Electrochemical Soc. 120, No. 10, pp. 1333–1339 (1973) and in U.S. Pat. No. 3,645,864; each of these disclosures is hereby incorporated herein by reference. It will often be desirable to add small, corrosion-resistant, conducting particles to the circulating anolyte 30 of FIG. 2 to facilitate contact and current flow between solid particles of carbonaceous material and the anode; in such instances the solid carbonaceous material, the said conductive particles and ash particles (if any) would be suspended in the electrolyte 30 and circulate therewith; ash is separated selectively from carbonaceous material and conductive particles by settling-chamber means at 33 or by other suitable means well known in the art.

Figure 3:
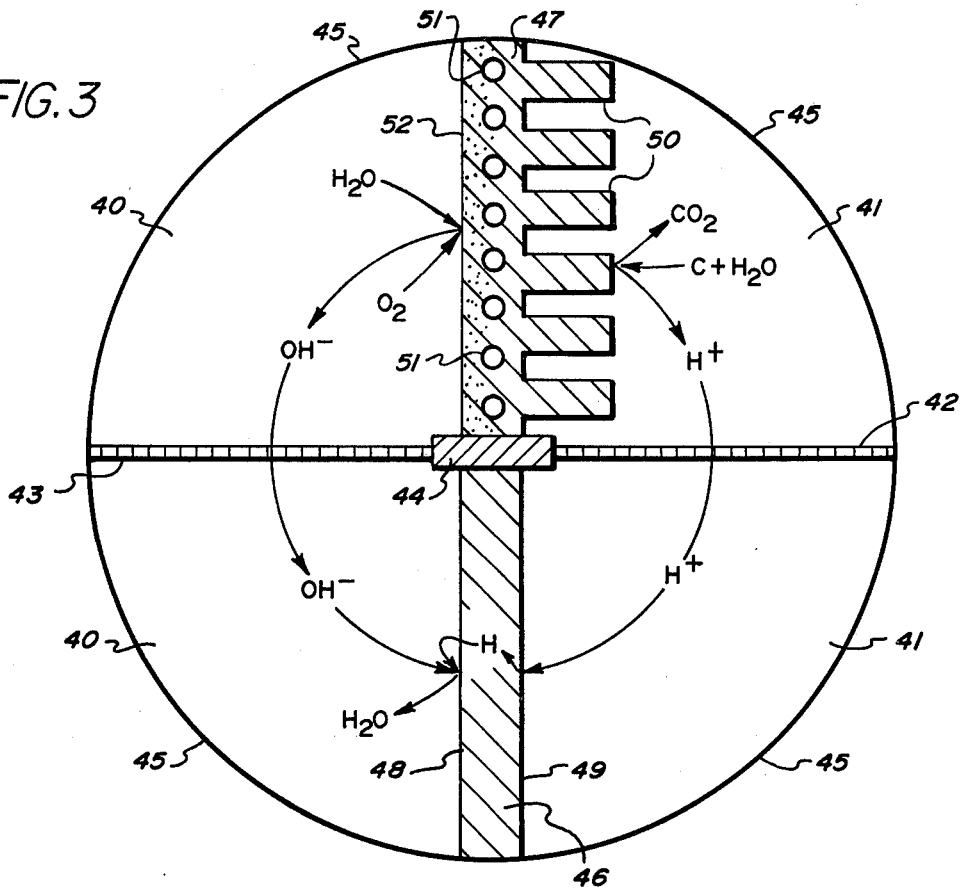
FIG. 3 is a schematic diagram of a system comprising an electrochemical gasification cell (hereinafter sometime referred to as EGC) and a hydrogen fuel cell (hereinafter sometimes called HFC) connected together and having electrodes in common.

FIG. 3 shows a planview of a combined HFC-EGC system having common electrodes in order to provide very low-resistance electrical pathways between the EGC and the HFC. With specific reference to FIG. 3 the left semicircular half of the circular device may be considered the HFC which contains the HFC electrolyte 40 and the right half the EGC which contains the EGC electrolyte 41. Both the EGC and the HFC are divided by the ion-permeable membranes, 42 and 43 respectively, each of which extends from the electrical insulator 44 to the electrically non-conductive container wall 45 which forms the cylindrical body of the device. The electrodes 46 and 47 also extend from insulator 44 to the walls of the cylindrical container 45. Electrode 46 serves as fuel cell electrode for the HFC and as cathode for the EGC. In a preferred embodiment electrode 46 is a porous carbon or ceramic element with a metal such as Pt supported on its surface. Suitable porous electrodes are disclosed in U.S. Pat. Nos. 2,615,933; 2,669,598; and 2,928,891. On the HFC side of electrode 46 (as signified by the electrode surface 48) the following reaction takes place:

(VII) $H_2+2OH^- \rightarrow 2H_2O+2e^-$ (at surface 48 of electrode 46)

On the EGC side of electrode 46 (as signified by the electrode surface 49) the following reaction takes place:

(VIII) $2H^+ + 2e^- \rightarrow 2H \rightarrow H_2$ (at surface 49 of electrode 46)

A portion of the hydrogen produced by the EGC according to reaction V at surface 49 migrates as molecules or gas through the porous electrode 46 to surface 48; another portion of the hydrogen produced by equation (VIII) can also migrate as atoms H by surface diffusion from 49 to 48 on the supported Pt of electrode 46; another portion of the hydrogen so produced can leave the device as product (not shown). At surface 48 of electrode 46 the migrated hydrogen is consumed in the fuel-electrode reaction (VII) as fuel for the HFC. The electrons produced at 48 by reaction (VII) pass through the conductive Pt portion of electrode 46 where they are consumed at 49 by reaction (VIII). Electrode 47 is more complex; its right hand side forms the anode of the EGC and comprises a non-porous, corrosion-resistant electrical conductor with extended surfaces 50 which contact the carbonaceous material to the anode compartment of the EGC and thereby abstract electrons therefrom according to the equation:

(IX) $C+2H_2O \rightarrow CO_2+4H^++4e^-$ (at surface 50 of electrode 47)

The electrons formed at surface 50 by equation (IX) flow to the left-hand side of the conductive electrode 47 where they participate in the oxygen electrode reaction of the HFC:

(X) $2e^- + \frac{1}{2}O_2 + H_2O \rightarrow 2OH^-$ (at surface 52 of electrode 46)

Oxygen is supplied for reaction (X) by means of the channels 51 in the electrode 47 which is porous between said channels 51 and its left-hand surface 52 at the HFC to permit transport of oxygen from said channels 51 to said surface 52 where reaction (X) takes place. As shown in FIG. 3 $OH^-$ ions formed at surface 52 of electrode 47 by the HFC oxygen electrode reaction (X) migrate through the HFC electrolyte 40 and through the ion permeable membrane 43 to surface 48 of electrode 46 where they are consumed by the HFC fuel electrode reaction (VII); in a similar fashion $H^+$ ions formed by the anodic oxidation of C according to reaction (IX) at extended surfaces 50 of electrode 47 migrate through the electrolyte 41 and the ion-permeable membrane 42 to surface 49 of electrode 46 where the $H^+$ is consumed by the EGC cathodic reaction (VIII). These migration paths are shown schematically in FIG. 3. In this device, carbonaceous material, C, and $H_2O$ are consumed and $CO_2$ and electrons produced at surface 50; oxygen, $H_2O$ and electrons are consumed and $OH^-$ produced at surface 52; hydrogen is produced and electrons consumed at surface 49; and water and electrons are produced and hydrogen and $OH^-$ consumed at electrode surface 48.

The system shown in FIG. 3 is a combination of an HFC and an EGC connected as in FIG. 1 with the major differences being that (1) the electrical connections are provided for the system of FIG. 3 via the electrodes shared or in common between the HFC and the EGC; (2) means are provided for the migration of hydrogen from EGC to HFC through porous electrode 46 instead of through ordinary conduit means as shown in FIG. 1. No means of introducing reactants or removing reaction products are shown in FIG. 3 because FIGS. 1 and 2 show how this may be accomplished.

Figure 4:
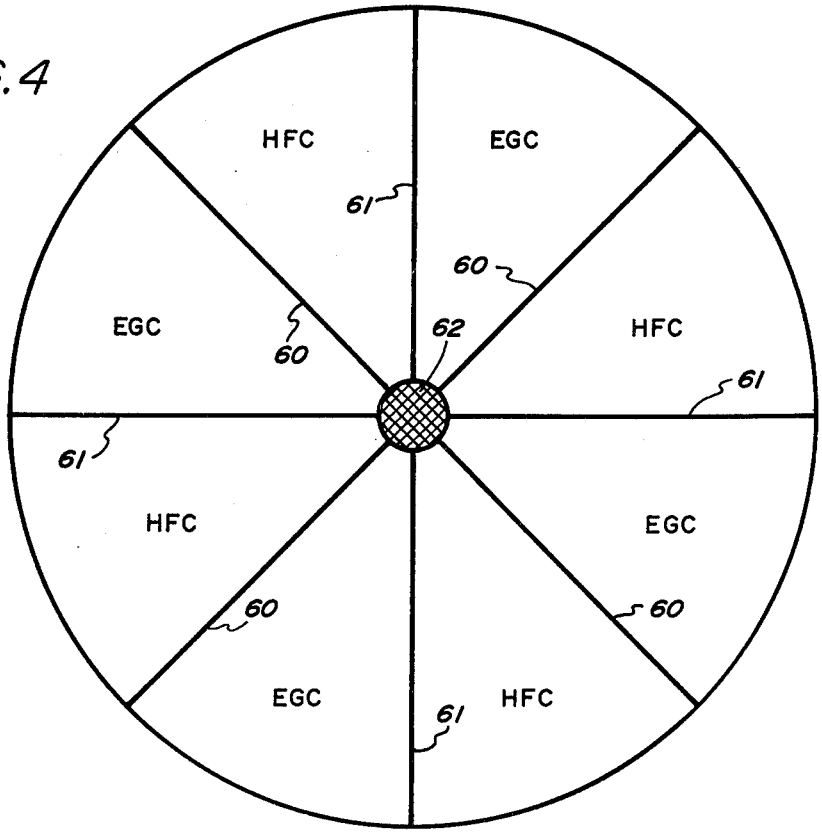
FIG. 4 shows a system similar to that in FIG. 3 but with several EGC's and HFC's in combination.

FIG. 4 is a schematic illustration of how several EGC's and HFC's can be interconnected as in FIG. 3 but all within a single cylindrical vessel and separated by the appropriate electrodes 60 (combined EGC cathode and HFC fuel electrode) and 61 (combined EGC anode and HFC anode and HFC oxygen electrode). These electrodes 60 and 61 extend from the central insulator 62 to the electrically non conductive cylindrical walls 63 of the vessel. Each EGC and HFC of FIG. 4 is also provided with an ion-permeable membrane extending from 62 to 63 but said membranes are not shown in the diagram; no means for introducing fuels and reactants or removing ash and reaction products are shown in FIG. 4 as the previous Figures and related description make it clear how to do so.

The foregoing processes and devices are capable of operation at atmospheric or higher pressures and temperatures ranging from room temperature up to several hundred degrees Celsius. For the EGC the electrode materials should be electrically conductive and chemically resistant; it will often be desirable for the EGC cathode to have low hydrogen over voltage. Preferred EGC electrolytes are aqueous salt solutions such as brine, and aqueous solutions of mineral acids such as $H_2SO_4$, $H_3PO_4$ and $HNO_3$. Many different materials and designs for HFC electrodes are now known in the art and accordingly can be combined with EGC's; similarly many such HFC's electrolytes are also known in the art and may be so used.

Additional embodiments of my invention are possible. For example, when dry, molten (or fused), metal-salt electrolytes are used in the EGC, then the corresponding elemental metals will be produced at the EGC cathode and then the EGC, if desired, could be combined with a corresponding high-temperature metal-fueled fuel cell which in most instances would also operate with its own molten or fused-salt electrolyte. Thus the method of electrochemical gasification permits the carbonaceous material to react to produce fuels or intermediates of more concentrated or more available more readily utilizable free energy, e.g. $H_2$, Na, Ca, K etc. The latter fuels can then be used for any desired purpose or to fuel a fuel cell (e.g. an HFC) which produces electricity to drive the EGC. Another example of a variation within the scope of my invention is the operation of an aqueous-electrolyte EGC without the ion-permeable membrane thereby allowing some carbonaceous material to migrate to the EGC cathode where it will be hydrogenated to produce gaseous and/or liquid hydrocarbons as products in addition to the hydrogen. Moreover it will also often be desirable to add various catalysts (either soluble or solid) to the EGC electrolytes to accelerate the desired chemical reactions at either electrode.

From the foregoing descriptions it will be clear that another advantage of my invention is that sulfurous and nitrogenous impurities in the carbonaceous fuel materials fed to the EGC will be anodically oxidized to high oxidation states and thereby enter the electrolyte from which they may be removed by continual or continuous purification of a side stream; gaseous oxides of sulfur and nitrogen will usually not be formed.

Various ion-permeable membranes may be used in the EGC part of my invention. Such membranes are well known in the electrolysis and fuel-cell art and include porous glass frits, porous Teflon membranes, glass-wool plugs, various gels and ion exchange membranes. Membranes for HFC's are discussed in various U.S. patents disclosing HFC art and incorporated above by reference.

In the diagrams of FIGS. 1, 3 and 4 the EGC is shown interconnected and in combination with one or more HFC's. The net production of such combinations can be as follows:

A. The production of only electrical energy from the fuel, in which cases all the hydrogen produced by the EGC is consumed by the HFC;

B. The production of only hydrogen, in which case the hydrogen consumed by the HFC is only just that sufficient to produce that amount of electrical energy required to drive the EGC;

C. The production of both electrical energy and hydrogen. It should be emphasized that the invention is equally operable when the EGC is driven by another source of electric energy, e.g. electric energy from an electrical power plant fueled by nuclear or fossil fuel; in the latter case all the hydrogen produced by the EGC could be considered a net product or a part of the hydrogen might be burned to produce electrical energy by a standard power cycle.

EXAMPLES

EXAMPLE 1

Ideal Thermodynamic Mass And Energy Balances For FIG. 1 System

Referring to FIG. 1 it is seen that 1 mole of carbon and 2 moles of $H_2O$ react in the EGC according to reaction (II) to produce 2 moles of $H_2$ and 1 mole of $CO_2$. To drive this reaction at room temperature 14.9 kcal ($\Delta F°$) of electrical energy is required. To provide this amount of electrical energy by an ideal HFC according to the equation:

$$\text{(XI)}\ H_2+\tfrac{1}{2}O_2\rightarrow H_2O \quad \Delta F^\circ=-54.6\ \Delta H^\circ=-57.8$$

only $(14.9/54.6)=0.273$ moles of $H_2$ need be consumed leaving $2-0.273=1.727$ moles of $H_2$ as the net production of the EGC-HFC system of FIG. 1. When 0.273 moles of $H_2$ are consumed in the HFC 0.137 moles of $O_2$ are also required and 0.273 moles of $H_2O$ are produced as also shown in FIG. 1. Simultaneously with the above production of this example, 21.5 kcal of thermal energy must be supplied to the EGC (e.g. by burning carbonaceous material or by resistive heating by additional electricity) and $(0.273)(57.8)=15.8$ kcal of thermal energy liberated by the HFC.

EXAMPLE 2

This example compares the EGC-HFC System of FIG. 1 with ordinary water electrolysis driven by electric energy from a typical coal-fired power plant; a comparison is also made with ordinary steam-gasification of coal according to equation I. The thermal energy required for the gasification of 1 mole of carbon in the EGC is 21.5 kcal and this will require the combustion of $(21.5/94.1)=0.23$ moles of carbon according to equation (II) for a net consumption of 1.23 moles of carbon in order to cause a net production of 1.73 moles of $H_2$ from the combined HFC-EGC system of FIG. 1.

When the required electrical energy is produced in a modern, coal-fired power plant of overall efficiency of about 50% we expect $(0.5)(94.1)=47$ kcal of electrical energy from burning 1 mole of carbon according to equation (III); 47 kcal of electrical energy would produce $47/54.6=0.86$ moles of $H_2$ by water electrolysis according to equation (VI).

The theoretical yield of hydrogen from steam gasification of coal according to combined reactions (II) and (III) is the production of 2 moles of $H_2$ from the consumption of 1.23 moles of carbon. Accordingly only about $(2-1.73)/2\cong 0.14\cong 14\%$ of the thermodynamically ideal net $H_2$ production from carbon is lost by using the EGC-HFC system as compared to conventional and ideal gasification+water gas shift (WGS) reaction (note that the WGS process will also be required with conventional gasification schemes to convert to $H_2$ the large amount of CO produced by conventional steam gasification). In practice this difference will be less than 14% in view of the relatively high efficiencies of the HFC and electrochemical processes as opposed to thermally driven steam gasification. This small difference (14% or less) is balanced by the fact that the EGC system requires neither a WGS process step nor an expensive $CO_2$ separation process step. As mentioned earlier the need for $SO_2$ and $NO_x$ separation is also obviated by the EGC. Furthermore the EGC operates at much milder conditions of temperature and pressure as compared to conventional steam gasification and this indicates that the EGC method entails process equipment of greatly reduced cost vis-a-vis hydrogen production by conventional steam gasification of carbonaceous materials.

To summarize, the expected, thermodynamically ideal net hydrogen production from one mole of c by the three methods are:

Coal Fired Power Plant+$H_2O$ Electrolysis—0.86 moles $H_2$

EGC+HFC—$1.73/1.23=1.4$ moles $H_2$

Conventional Steam Gasification (Including WGS+$CO_2$ Separation)—$2/1.23=1.6$ moles $H_2$

EXAMPLE 3

Reduction of Ohmic Losses

Consumption of 100 tons carbon/hr is equivalent to about:

$$100\,\frac{\text{ton}}{\text{hr}} \times 2000\,\frac{\text{lb}}{\text{ton}} \times \frac{454}{12}\,\frac{\text{g moles}}{\text{lb}} \times 4\,\frac{\text{equival.}}{\text{g mole}} \times \frac{96500\ \text{coulomb}}{\text{equivalent}} \times \frac{1\ \text{hr}}{3600}\ \text{sec} \cong 10^7\ \text{amperes(coulombs/sec)}.$$

Since the potential across the EGC will be on the order of one volt this means about 10 megawatts rate of energy exchange between the EGC and HFC at this rate of coal consumption. Ohmic losses associated with $10^7$ amperes flowing through ordinary conductors are prohibitively high. With common or shared electrodes as shown in FIG. 3, however, and a current of $10^6$ amperes ($\sim 10^6$ watts at $\sim 1$ volt) a 0.1% power loss ($10^3$ watts) would require an electrode area-to-thickness ratio (A/l) computed as follows for a conductor (e.g. steel) of resistivity $10^{-6}\ \Omega$ −cm:

$$A/l = (10^6)^2 \cdot 10^{-6}/10^3 = 10^3\ \text{cm}^2/\text{cm}.$$

This indicates an electrode 1 cm thick of 1000 $cm^2$ area would suffice to limit internal power loss to 0.1%.

The foregoing examples and embodiments are given for illustrative purposes only and are not intended to limit the scope of the invention.

What I claim and intend to be covered by Letters Patent is:

1. A method of electrochemically oxidizing a carbonaceous material at an anode of an electrolysis cell and simultaneously producing a useful fuel or chemical at the cathode of said cell, the overall energy change accomplished by said electrolysis cell being supplied in part by the oxidation of said carbonaceous material at said anode and in part by electrical energy produced by a fuel cell fueled by at least a portion of said useful fuel or chemical produced at said cathode by said electrolysis cell, said fuel cell and said electrolysis cell being electrically interconnected by virtue of having shared or common electrodes.

2. The method as defined by claim 1 wherein one electrode (a) serves simultaneously as anode of the electrolysis cell and cathode of the fuel cell and the other electrode (b) serves simultaneously as cathode of the electrolysis cell and anode of the fuel cell.

3. The method as defined by claim 2 wherein the said electrode (a) is provided with channels for the supply of an oxidizing gas and is porous to permit the transport of said oxidizing gas from said channels to the surface of said electrode (a) in contact with the fuel cell electrolyte, and wherein the said electrode (b) is porous to permit the transport of said useful fuel from the electrolysis-cell side to the fuel-cell side.

4. The method as defined by claim 3 wherein the said electrode (b) also contains a catalyst to activate said useful fuel produced at the electrolysis cell side.

5. The method as defined by claim 2 wherein several such combinations of fuel cell and electrolysis cell are connected and operated in series with said interconnections accomplished by virtue of shared or common electrodes between each neighboring fuel cell and electrolysis cell.

6. A method of obtaining hydrogen comprising the steps of:

introducing carbonaceous solids and an aqueous electrolyte to an electrolysis cell having a cathode electrode and an anode electrode;

applying an electromotive force across said electrodes; whereby oxides of carbon are produced at the anode of said cell and hydrogen is produced at the cathode of said cell; and accumulating the hydrogen produced at said cathode.

7. The method as defined by claim 6 further comprising the step of accumulating the oxides of carbon produced at said anode.

8. The method as defined by claim 6 wherein said electrolyte is an aqueous solution selected from the group consisting of mineral acids, bases and salts.

9. The method as defined by claim 6 wherein said carbonaceous solids are selected from the group consisting of coals, lignites and chars.

10. The method as defined by claim 8 wherein said carbonaceous solids are selected from the group consisting of coals, lignites and chars.

* * * * *